US006354572B1

(12) United States Patent
Menassa

(10) Patent No.: US 6,354,572 B1
(45) Date of Patent: Mar. 12, 2002

(54) FLOW-THROUGH HUMIDIFIER

(76) Inventor: Chérif Menassa, 39 Shédiac, Kirkland (CA), H9J 2J8

( * ) Notice: Subject to any disclaimer, the term of this patent is extended or adjusted under 35 U.S.C. 154(b) by 0 days.

(21) Appl. No.: 09/607,941

(22) Filed: Jun. 30, 2000

Related U.S. Application Data

(60) Provisional application No. 60/142,397, filed on Jul. 6, 1999, now abandoned.

(51) Int. Cl.[7] ..... F02M 1/10

(52) U.S. Cl. ..... 261/39.1; 261/106; 261/DIG. 15; 261/DIG. 34; 261/DIG. 88

(58) Field of Search ..... 261/106, 39.1, 261/DIG. 15, DIG. 34, DIG. 41, DIG. 88; 126/113

(56) References Cited

U.S. PATENT DOCUMENTS

| | | | | | |
|---|---|---|---|---|---|
| 3,171,401 | A | * | 3/1965 | McDuffee | 261/DIG. 15 |
| 3,190,624 | A | * | 6/1965 | McElreath | 261/DIG. 34 |
| 3,537,692 | A | * | 11/1970 | Vick | 261/DIG. 34 |
| 3,799,513 | A | * | 3/1974 | Winton | 261/106 |
| 3,811,661 | A | * | 5/1974 | Procter | 261/106 |
| 3,823,926 | A | * | 7/1974 | Bracich | 261/106 |
| 4,165,835 | A | * | 8/1979 | Dearling | 261/DIG. 88 |
| 4,595,139 | A | | 6/1986 | Levine | |
| 4,994,211 | A | | 2/1991 | Fuller | |
| 5,037,586 | A | * | 8/1991 | Mehrholz et al. | 261/DIG. 15 |
| 5,425,902 | A | * | 6/1995 | Miller et al. | 261/DIG. 34 |
| 5,765,544 | A | | 6/1998 | Vigansky, Jr. | |
| 5,901,905 | A | | 5/1999 | Jung | |
| 5,919,533 | A | | 7/1999 | Smith et al. | |
| 5,932,148 | A | * | 8/1999 | Hansell, Jr. et al. | 261/106 |
| 5,948,324 | A | * | 9/1999 | Cook | 261/106 |
| 5,965,068 | A | * | 10/1999 | Williamson et al. | 261/DIG. 15 |

* cited by examiner

*Primary Examiner*—C. Scott Bushey

(57) ABSTRACT

The present invention provides flow-through humidifier device having a frame assembly adapted to be secured onto an air supply duct and having a back wall with an air inlet opening, two side walls, one with an air outlet opening, top and bottom walls and a front cover wall, an evaporator assembly including a pad, a water supply member and a water drain member to supply unfiltered water at standard city pressure to and collect any excess of water from the pad member respectively. The water supply member includes a valve controlled by an air temperature electronic controller. The latter is electrically connected to a temperature sensor sensing the temperature of the air flowing and timely pulses the valve to open when the air temperature is above a pre-determined set temperature and allow for water to humidify the pad. The top and bottom walls of the frame assembly are preferably a mirror image of each other such that the humidifier can be mounted in either an upright or an upside down orientation depending on the right or left hand side desired position of the air outlet opening respectively.

14 Claims, 4 Drawing Sheets

FLOW-THROUGH HUMIDIFIER

CROSS-REFERENCE TO RELATED APPLICATION

The application is related to a previously filed provisional application No. 60/142,397, filed on Jul. 6, 1999, now abandoned.

FIELD OF THE INVENTION

The present invention relates to humidifiers and more specifically to flow-through humidifiers typically installed in a by-pass configuration into a house furnace air duct supply, or the like.

BACKGROUND OF THE INVENTION

Flow-through type humidifiers are widely used in conjunction with air heating systems. The humidifier housing is installed against a hot air duct supply. Hot air flows from an opening in the duct supply into the humidifier housing to go through a humidifier vertical pad and finally return to the return duct via a by-pass piping connected to the humidifier housing. In order to keep the pad humid, water is supplied to a diffuser located above the pad that uniformly distribute the water along the pad. The water then flows down the pad and any excess that is not evaporated into the flowing air is collected at the bottom of the pad into a drain.

Typically, the flow of water is too large thereby causing a significant amount of wasted water. To reduce the amount of wasted, some humidifiers include a water flow limiting device consisting of an iris with a small access hole. The access hole is so small that it can be easily obstructed, blocking any water flow. Alternatively, a small filter may be introduced to eliminate these possible obstructions. In this case, the filter, usually not easily accessible, requires yearly maintenance, which is cumbersome for most of the people. Furthermore, the low pressure and the small water flow rate downstream of the valve require either an almost perfect leveling of the water diffuser or a sophisticated diffuser design to ensure a uniform water distribution over the whole pad, otherwise a small portion of the pad is humidified thereby reducing the efficiency of the humidifier.

Furthermore, to avoid water waste when no air is flowing through the humidifier, some other humidifiers include a water valve interlock. The valve interlock is a current sensing relay detecting current going through the common wire lead of the furnace blower motor. With the valve interlock, the system checks that the ventilation is working and assumes that the furnace is in operation, which may not be always the case. This system may also waste water if the air going through the humidifier is too cold since relatively hot air is required for the water to evaporate.

OBJECTS OF THE INVENTION

It is a first object of the present invention to provide a humidifier that obviates the above-mentioned disadvantages.

It is a further object to provide a humidifier that includes a temperature sensor device used to control the supply of water depending on the temperature of the flowing air and/or air duct confirming that the furnace is in operation.

It is another object to provide a humidifier that includes an electronic circuit controller that pulses the opening of a solenoid valve to control the amount of water going to the pad for evaporation.

It is a further object to provide a humidifier that includes a symmetrical frame assembly adapted to be installed either upright or in an upside down orientation depending on the desired left or right hand side position of the air outlet opening.

SUMMARY OF THE INVENTION

The present invention provides a flow-through humidifier device comprising:

a frame assembly for securing onto an air supply duct and having three side walls, a top and a bottom walls and a front cover wall, a first and a second of said side walls having an air inlet opening and an air outlet opening respectively;

an evaporator assembly including a pad member adapted to be vertically disposed between and held by said top and bottom walls and being generally adjacent to said air inlet opening to substantially cover the same, a water supply member removably mounted to said top wall for supplying water to said pad member, and a water drain member mounted to said bottom wall to collect any excess of water from said pad member;

said water supply member including a valve member controlled by an air temperature controller, said air temperature controller includes an electronic circuit electrically connected to a temperature sensor and timely pulses a solenoid valve of said valve member to allow for a specific amount of water to intermittently humidify said pad member for constant time intervals when the sensed temperature of said air supply duct is higher than a pre-determined set temperature, thereby humidifying hot air flowing through said pad member of said humidifier device.

Preferably, the first side wall is a back wall adapted to be secured onto said air supply duct.

Preferably, the air temperature controller is further connected to a humidity sensor, said air temperature controller timely pulsing said solenoid valve to allow said water to intermittently reach said pad member when both said temperature of said air supply duct is higher than said predetermined set temperature and said humidity sensor detects a humidity level that is below a pre-set humidity comfort level.

Preferable the water supply member further includes a water diffuser that uniformly distributes said water over said pad member.

Preferably, the water drain member includes a pan over which said pad member is located to collect said excess of water dripping therefrom and a drain outlet to drain out said excess of water from humidifier device.

Preferably, the pan and said drain outlet are integral to said bottom wall.

Preferably, the top and bottom walls of said frame assembly are a mirror image of each other such that said humidifier device can be mounted onto said air duct supply in an upside down orientation with said water supply member removably mounted to said bottom wall to supply water to said pad member, and said water drain member mounted to said top wall to collect any excess of water from said pad member, thereby allowing for said air outlet opening to be effectively oriented in an opposite direction as if it would have been on the other of said two side walls.

Preferably, the frame assembly is made out of an essentially flat main piece including said back, top, bottom and side walls, said main piece being foldable at interfaces between adjacent walls and releasably locked in folded position using fastening devices, and a cover piece being said cover wall and adapted to be removably fastened over said folded main piece to close said frame assembly.

Preferably, the frame assembly is made out of molded thermoplastic material.

Preferably, the air outlet opening includes an externally protruding collar adapted to receive a by-pass return pipe.

Preferably, the humidifier device further includes a deodoriser body releasably secured inside said frame assembly in proximity to said air outlet opening.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
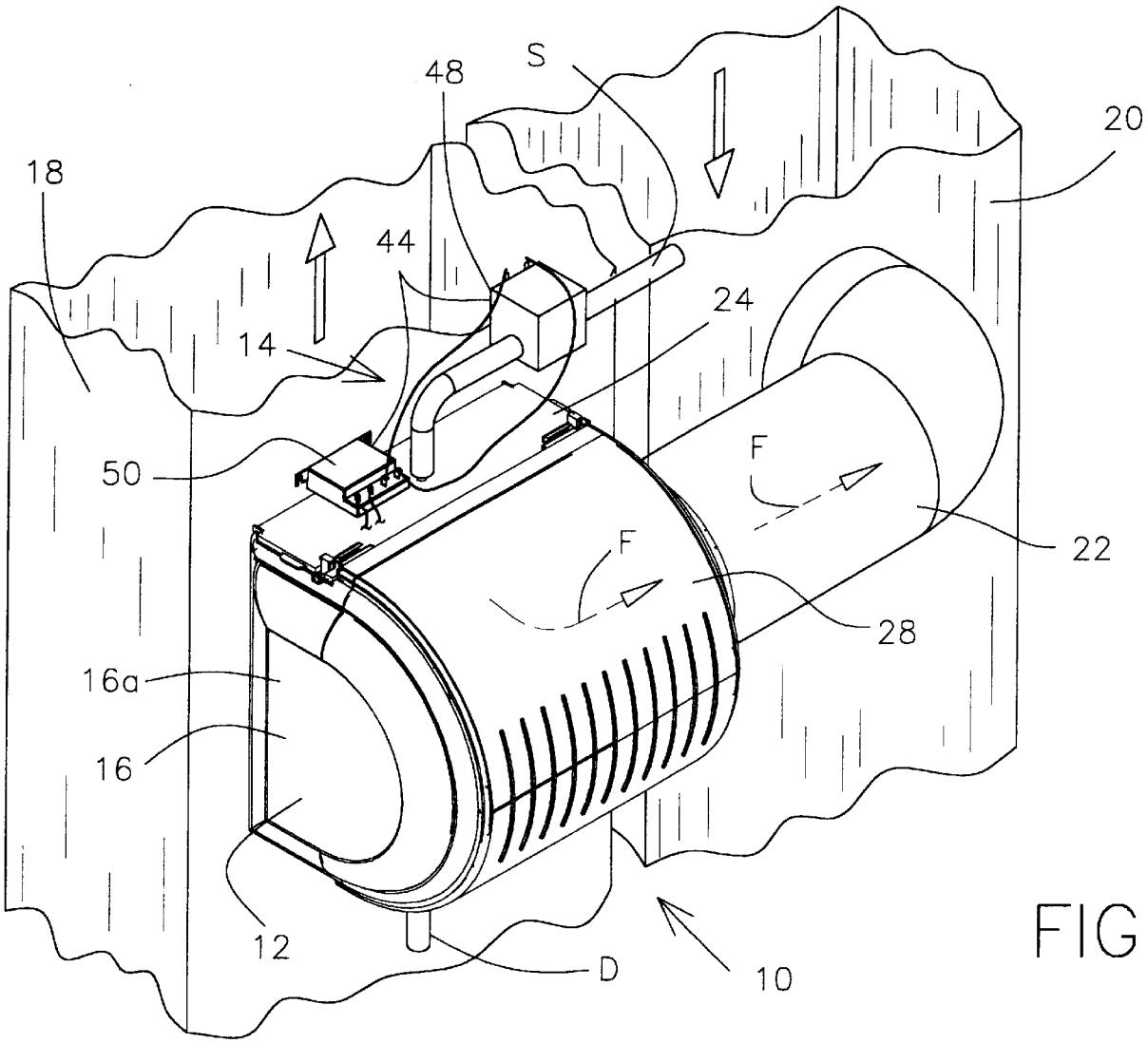
FIG. 1 is a front perspective view of a typical installation of an embodiment according to the humidifier of the present invention.

Referring to FIGS. 1 to 4, there is shown an embodiment 10 according to a flow-through humidifier of the present invention. The humidifier 10 consists of a frame assembly 12 and an evaporator assembly 14. The frame assembly 12 includes three side walls 16, one of which, preferably the central and back wall 16*b*, is adapted to secure the frame assembly 12 onto a hot air supply duct 18 of a hot air heating system with a furnace or the like. One of the other two side walls 16*a*, 16*c* is connected to a cool air return duct 20 via a by-pass return pipe 22. The frame assembly 12 also includes top 24 and bottom 26 walls preferably releasably supporting a front cover 28.

Accordingly, the back wall 16*b* has a preferably generally rectangular air inlet opening 30 and is preferably rigidly secured to the supply duct 18 via preferably four (4) screw attachment members (not shown) inserted into corresponding mounting slot openings 32. The air duct 18 has an opening that is adapted to receive an outwardly protruding flange 34 located at the perimeter of the inlet opening 30. Similarly, the side wall 16*c* has a preferably generally circular air outlet opening 36 with an outwardly protruding collar 38 adapted to fixedly receive the by-pass return pipe 22 secured by a collar clamp 40.

Internal to the housing 12, and essentially covering the inlet opening 30, there is the evaporator assembly 14 that includes a pad member 42, a water supply member 44 and a water drain member 46 to essentially supply water to and collect the same from the pad member 42 respectively.

The pad member 42 is adapted to be vertically disposed between the top and bottom walls 24, 26, and retained by a downwardly 24*a* and an upwardly 26*a* protruding short inner walls respectively. The pad 42 is shown in operative position in FIG. 2, in dashed lines. The water supply member 44 includes a valve member 48 controlled by an air temperature controller 50 opening the latter to allow for water coming from a water supply pipe S to reach and humidify the pad 42, and the hot air flowing through the same in the direction of arrows F, when the temperature of the air supply duct 18 is over a pre-determined set temperature. Preferably, the water supply member 44 also includes a water distribution diffuser 52 adapted to receive the water coming from the valve member 48 down through a feed pipe 54 to an opening 56 in the top wall 24. The diffuser 52 is a generally elongated body 58 having a plurality of preferably equally spaced apart diffusing holes 60 (see FIGS. 3 and 4) along the body 58 located over the pad 42 to uniformly distribute the supplied water on the pad 42. Because the high pressure, such as standard city pressure, and the relatively high flow rate of the unfiltered water reaching the diffuser 52 ensure the uniform distribution of the water to all diffusing holes 60, no specific leveling of the diffuser 52 is necessary. The water drain member 46 includes a pan 62 over which the pad 42 is installed and adapted to collect any excess of water dripping from it and connected to a water drain pipe D via a drain outlet, preferably a hole 64 through the bottom wall 26. Preferably, the pan 62 is integral to the bottom wall 26 of the frame assembly 12 and is made out of peripheral side walls 66 surrounding a slightly downwardly inclined bottom floor 68 towards its center where hole 64 is located.

The air temperature controller 50 includes an electronic circuit 70 electrically connected to a temperature sensor (not shown), preferably located inside the controller 50, itself preferably mounted on the air supply duct 18 close to the humidifier 10. When the temperature sensed by the temperature sensor reaches or is over the pre-determined set temperature, the electronic circuit 70 timely pulses the valve member 48, preferably a solenoid valve, controlling the quantity of water intermittently going to the pad 42. The duration, or constant time interval, of the pulse keeping the valve 48 opened is pre-calibrated depending on the typical hot air temperature and its flow rate, in order to almost eliminate any waste of water that would not evaporate and flow down the drain pipe D.

Preferably, the temperature controller 50 is series connected to an adjustable humidity sensor 72 located in a room fed by the air heating system and that cuts the power supply, preferably from a transformer 74, to the controller 50 when the humidity level sensed by the humidity sensor 72 is above an adjusted pre-set humidity comfort level.

The present invention also significantly reduces any waste of water in the case of a heating system failure with the furnace still supplying cold air; since that cold air, by flowing through the humidifier 10, would essentially not induce any evaporation of water from the pad 42.

Having the proper amount of water flowing down the pad 42 improves the efficiency of the humidifier 10 as well as its maintenance free period duration. The present invention also allows for minimum water flow sufficient to always maintain the pad 42 slightly humid thus preventing any possible accumulation of small depositions contained in the water or the air that would reduce the humidifier efficiency.

Figure 2:
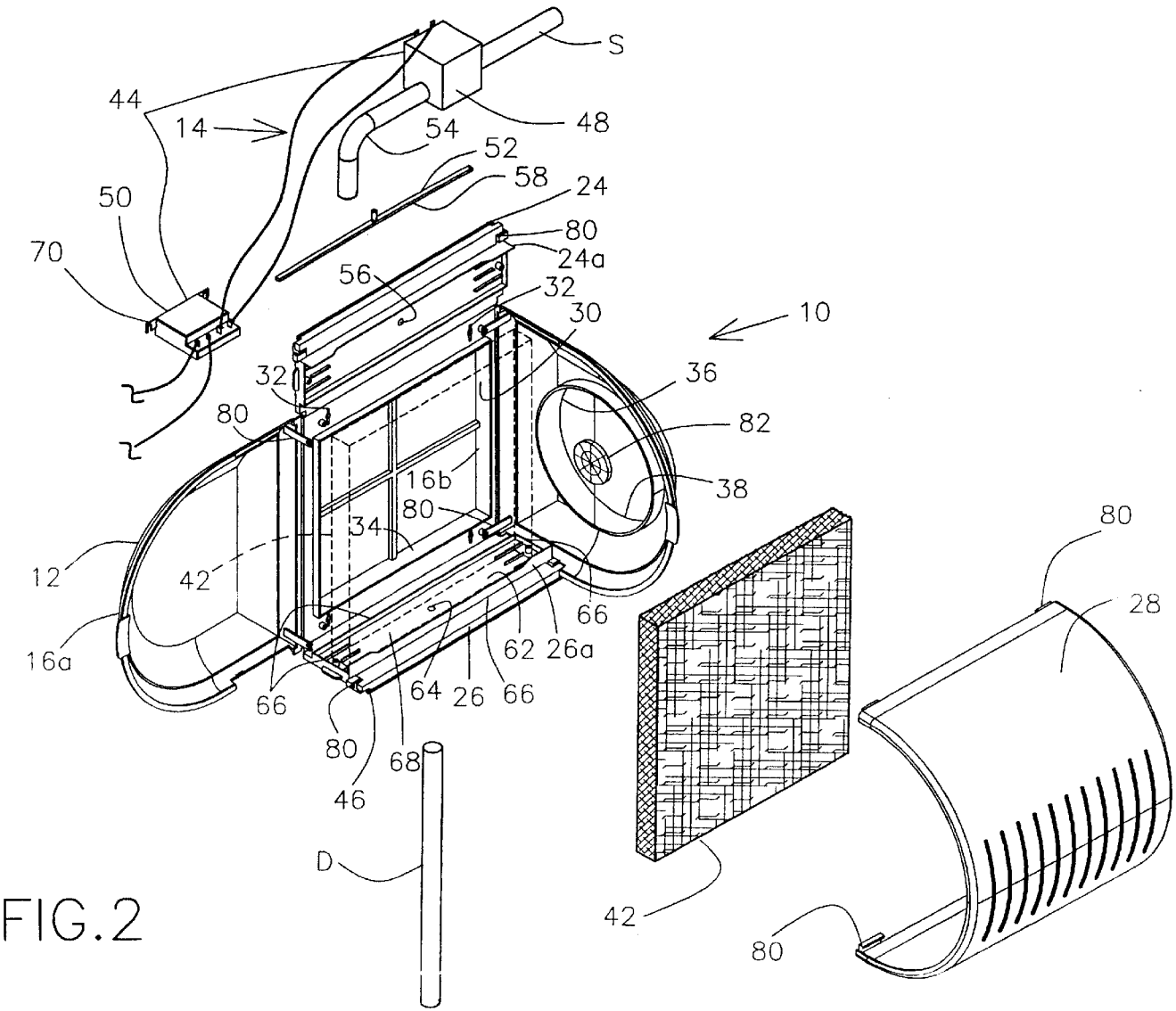
FIG. 2 is an exploded and partially opened perspective view of the embodiment of FIG. 1.
Figure 4:
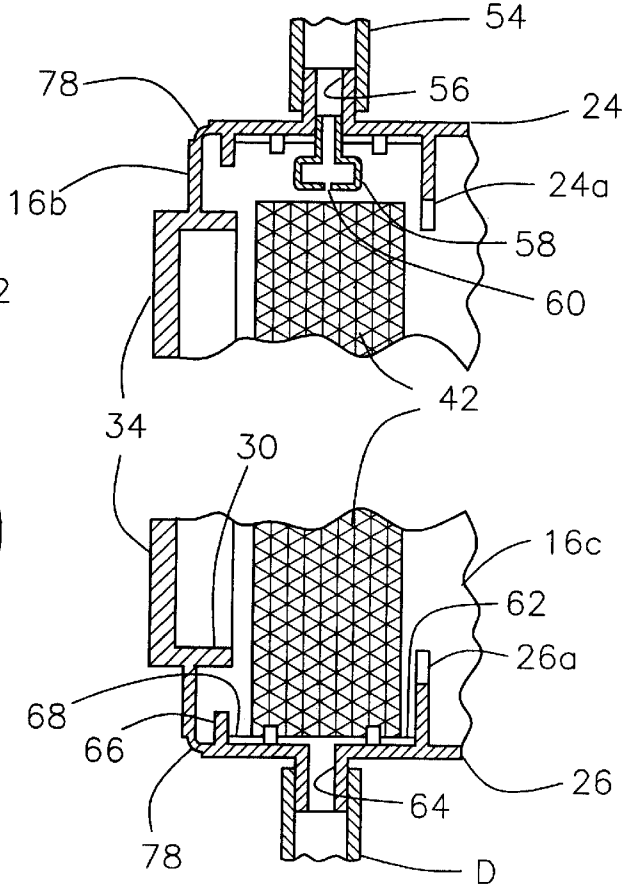
FIG. 4 is an enlarged section view taken along line 4—4 of FIG. 3, and FIGS. 5 and 6 are front and back views of the unfolded main piece of the frame assembly of the embodiment of FIG. 1 showing the inside and the outside respectively.
Figure 3:
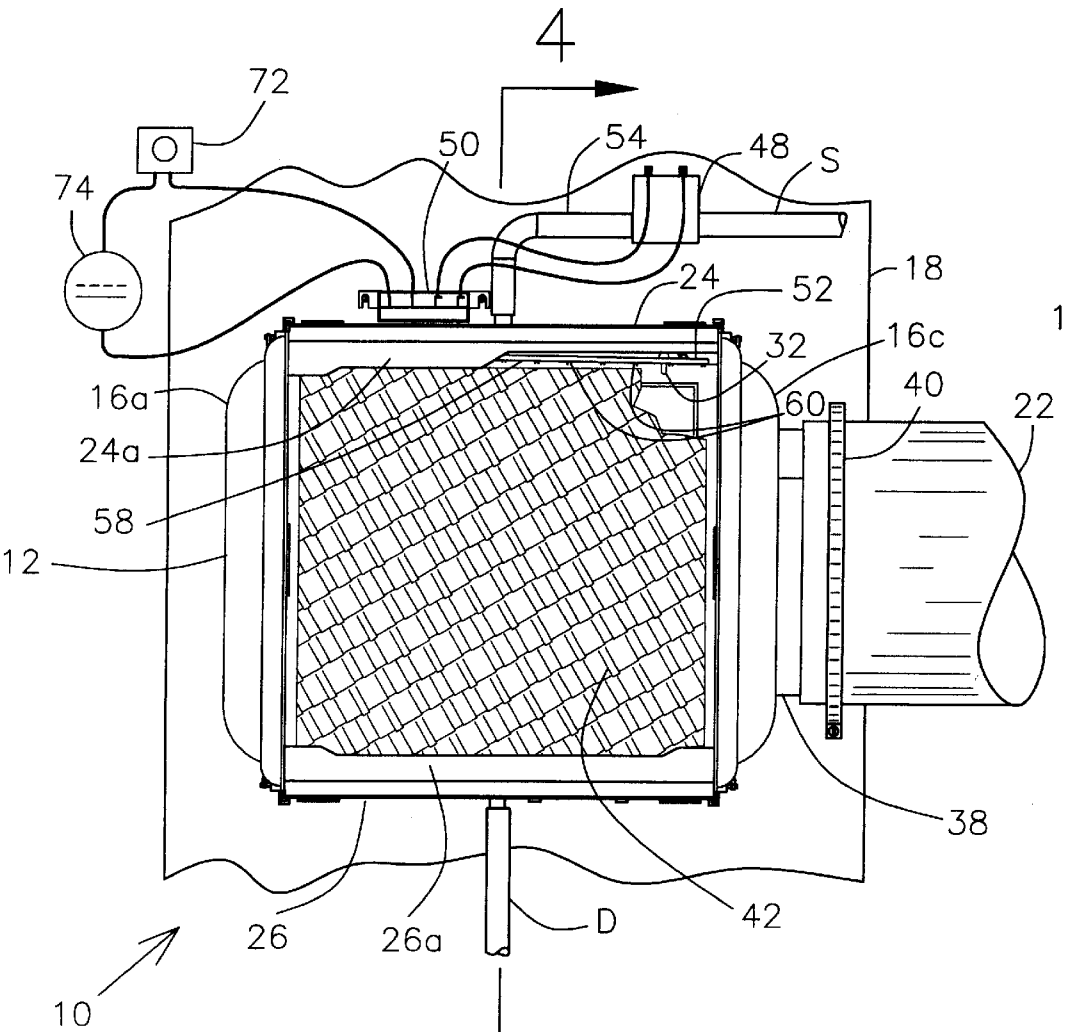
FIG. 3 is a partially sectioned front elevational view of the embodiment of FIG. 1, without its cover.

Preferably, the top 24 and bottom 26 walls of the frame assembly 12 are a mirror image of each other such that the humidifier 10 can be mounted onto the air supply duct 18 in either an upright orientation as shown in FIGS. 1 to 3 with the by-pass return pipe 22 on the right hand side of the humidifier 10, or in an upside down orientation (not shown) to have the return pipe 22 on the left hand side of the humidifier 10, to accommodate both types of installation.

Accordingly, in the upside down orientation, the water supply member 44 and water drain member 46 are located on the bottom 26 and top 24 walls respectively. Obviously, all side walls 16*a*, 16*b*, 16*c* are essentially symmetrical with respect to a horizontal centerline H.

Figure 5:
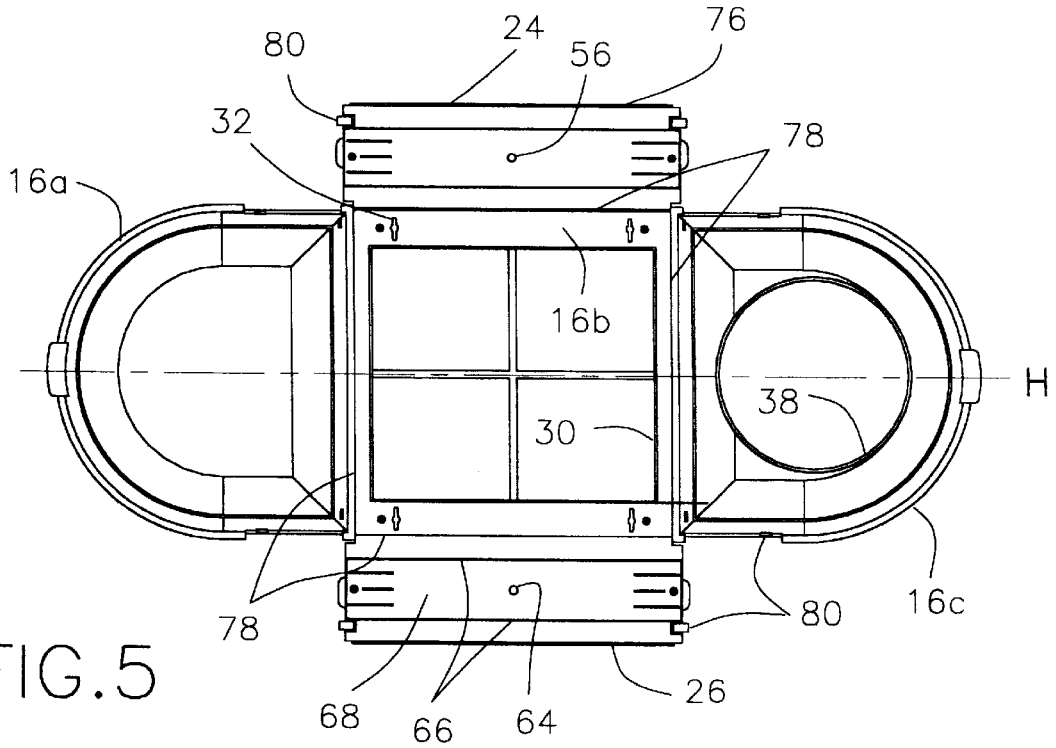
Figure 6:
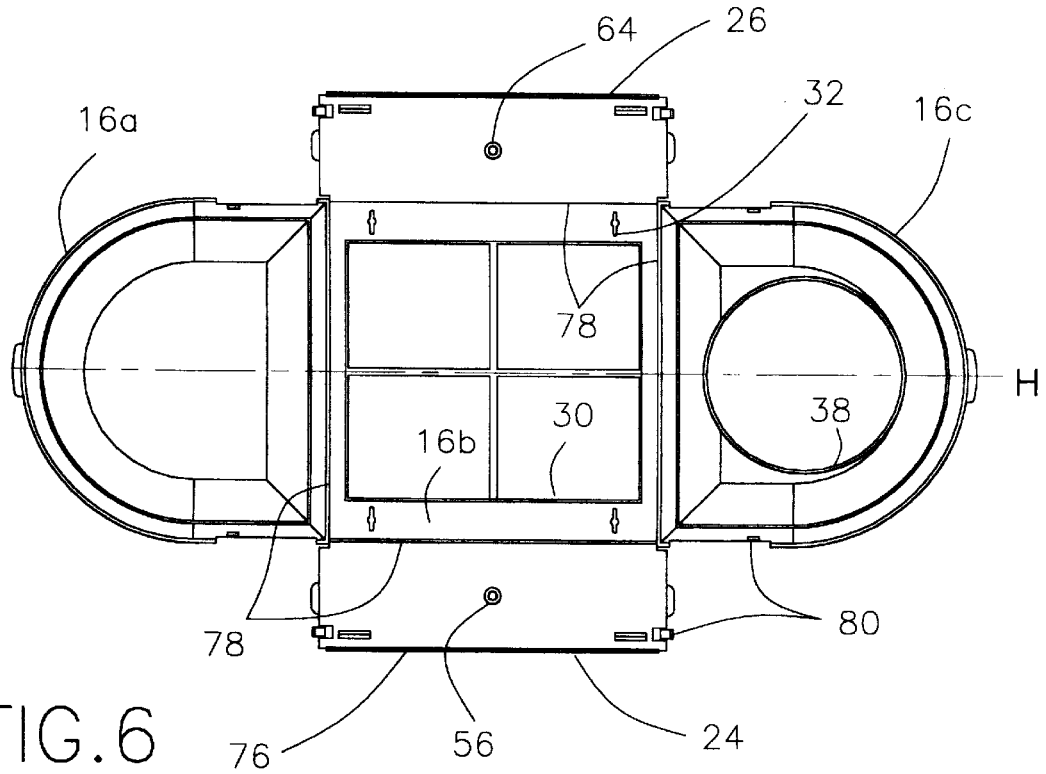

As shown on FIGS. 5 and 6, the frame assembly 12 is preferably made out of a substantially flat main piece 76 that includes the back wall 16*b*, the other two side walls 16*a*, 16*c* and the top 24 and bottom 26 walls. The back wall 16*b* is linked to all other adjacent walls 16*a*, 16*c*, 24, 26 via respective fold line intersections 78 allowing for the latter four to be folded over to form a partially closed frame assembly 12. Different attachment members 80, preferably of the snapping type, are used to releasably secure all folded adjacent walls to each other. The frame assembly 12 is then completely closed by a preferably separate cover piece 28 adapted to be easily removable from the main piece 76 when required. To better access the pad 42, the bottom wall is also easily released from side walls 16*a*, 16*c* and downwardly hinged about its fold line intersection 78 with the back wall 16*b*.

Furthermore, it would be obvious to anyone skilled in the art that the humidifier device 20 could alternatively be mounted onto the cool air return duct 20 with the by-pass return pipe connected to the hot air supply duct 18, with the air flowing from the outlet opening 36 toward the inlet opening 30. In this alternate configuration, it is to be noted that the controller 50 remains mounted on the air supply duct 18 for the internal temperature sensor to sense the hot air temperature.

Preferably, all walls 16, 24, 26 and cover 28 are made out of molded thermoplastic material, but could also be made out of any suitable water resistant metallic material.

Also, the humidifier 10 preferably includes a deodorant body 82 is removably secured inside the frame assembly 12, preferably in proximity of the air outlet opening 38, so as to deodorise the humidified hot air flowing through the latter and before entering the by-pass return pipe 22.

Although an embodiment has been described herein with some particularity and details, many modifications and variations of the preferred embodiment are possible without deviating from the scope of the present invention.

I claim:

1. A flow-through humidifier device comprising:

a frame assembly for securing onto an air supply duct and having three side walls, a top and a bottom walls and a front cover wall, a first and a second of said side walls having an air inlet opening and an air outlet opening respectively;

an evaporator assembly including a pad member adapted to be vertically disposed between and held by said top and bottom walls and being generally adjacent to said air inlet opening to substantially cover the same, a water supply member removably mounted to said top wall for supplying water to said pad member, and a water drain member mounted to said bottom wall to collect any excess of water from said pad member;

said water supply member including a valve member controlled by an air temperature controller, said air temperature controller includes an electronic circuit electrically connected to a temperature sensor and timely pulses a solenoid valve of said valve member to allow for a specific amount of water to intermittently humidify said pad member for constant time intervals when the sensed temperature of said air supply duct is higher than a pre-determined set temperature, thereby humidifying hot air flowing through said pad member of said humidifier device.

2. A humidifier device as defined in claim 1, wherein said first side wall is a back wall for securing onto said air supply duct.

3. A humidifier device as defined in claim 1, wherein said air temperature controller is further connected to a humidity sensor, said air temperature controller timely pulsing said solenoid valve to allow said water to intermittently reach said pad member when both said temperature of said air supply duct is higher than said pre-determined set temperature and said humidity sensor detects a humidity level that is below a pre-set humidity comfort level.

4. A humidifier device as defined in claim 1, wherein said water supply member further includes a water diffuser that uniformly distributes said water over said pad member.

5. A humidifier device as defined in claim 4, wherein said water drain member includes a pan over which said pad member is located to collect said excess of water dripping therefrom and a drain outlet to drain out said excess of water from humidifier device.

6. A humidifier device as defined in claim 5, wherein said pan and said drain outlet are integral to said bottom wall.

7. A humidifier device as defined in claim 1, wherein said top and bottom walls of said frame assembly are a mirror image of each other such that said humidifier device can be mounted onto said air duct supply in an upside down orientation with said water supply member removably mounted to said bottom wall to supply water to said pad member, and said water drain member mounted to said top wall to collect any excess of water from said pad member, thereby allowing for said air outlet opening to be effectively oriented in an opposite direction as if it would have been on the other of said two side walls.

8. A humidifier device as defined in claim 7, wherein said frame assembly is made out of a substantially flat main piece including said back, top, bottom and side walls, said main piece being foldable at interfaces between adjacent walls and releasably locked in folded position using fastening devices, and a cover piece being said cover wall and removably fastening over said folded main piece to close said frame assembly.

9. A humidifier device as defined in claim 8, wherein said frame assembly is made out of molded thermoplastic material.

10. A humidifier device as defined in claim 1, wherein said air inlet and outlet openings each includes an externally protruding collar for receiving a by-pass forward pipe and a by-pass return pipe respectively.

11. A humidifier device as defined in claim 1, wherein said air outlet opening includes an externally protruding collar for receiving a by-pass return pipe.

12. A humidifier device as defined in claim 1, wherein said frame assembly is made out of a substantially flat main piece including said back, top, bottom and side walls, said main piece being foldable at interfaces between adjacent walls and releasably locked in folded position using fastening devices, and a cover piece being said cover wall and removably fastening over said folded main piece to close said frame assembly.

13. A humidifier device as defined in claim 1, including a deodoriser body releasably securing inside said frame assembly in proximity to said air outlet opening.

14. A humidifier device as defined in claim 8, including a deodoriser body releasably securing inside said frame assembly in proximity to said air outlet opening.

* * * * *